United States Patent [19]

Maxwell et al.

[11] 4,007,602

[45] Feb. 15, 1977

[54] EXTERIOR ICE SERVICE FOR FREEZER-REFRIGERATORS

[75] Inventors: Richard D. Maxwell; John J. Pink; Michael J. Fitzharris, all of Cedar Rapids; Louis R. Marz, Homestead, all of Iowa

[73] Assignee: Amana Refrigeration, Inc., Amana, Iowa

[22] Filed: Sept. 8, 1975

[21] Appl. No.: 610,972

Related U.S. Application Data

[62] Division of Ser. No. 433,902, Jan. 16, 1974, Pat. No. 3,911,692.

[52] U.S. Cl. ..... 62/137

[51] Int. Cl.[2] ..... F25C 1/10

[58] Field of Search ..... 62/137, 344, 377; 312/271, 276, 311

[56] References Cited

UNITED STATES PATENTS

| | | | |
|---|---|---|---|
| 3,195,970 | 7/1965 | Chuboff | 312/311 |
| 3,744,270 | 7/1973 | Wilcox | 62/377 X |

*Primary Examiner*—William E. Wayner
*Assistant Examiner*—William E. Tapolcai
*Attorney, Agent, or Firm*—James C. Nemmers; Haven E. Simmons

[57] ABSTRACT

A freezer-refrigerator unit is provided with exterior ice service through the front of the cabinet. The unit has a panel forming a portion of the front closure of the freezer compartment and hinged at its lower edge to swing outwardly. Behind the panel is an ice tray, and the tray is supplied with ice cubes from an automatic ice maker located in the freezer compartment.

1 Claim, 4 Drawing Figures

EXTERIOR ICE SERVICE FOR FREEZER-REFRIGERATORS

This application is a division of application Ser. No. 433,902, filed Jan. 16, 1974, now U.S. Pat. No. 3,911,692.

BACKGROUND OF THE INVENTION

There are numerous current methods of rendering ice or ice cubes accessible at the front of a freezer-refrigerator, for example, without need to open one of its main doors. This is helpful, because the door of the freezer compartment is relatively large, and when opened much cold air is lost and warm air introduced, all when merely a few pieces of ice are desired at the time. In some contemporary arrangements, power driven means dispense the ice piece-by-piece from an interior reservoir directly through the freezer door, or through a fixed front panel between a pair of freezer doors as in the co-pending application of John J. Pink et al, Ser. No. 271,797, filed July 14, 1972, now U.S. Pat. No. 3,798,923. In still others, an entrance is formed through the freezer door and closed by a separate panel hinged to the door. On the inner face of the panel is hung a bin which serves as the reservoir for ice from an ice maker. Or instead of a bin, a drawer-like reservoir is engaged with the panel only when the freezer door is closed so that when the panel is then swung open, the drawer is drawn part way out through the door for access to the ice. In yet another approach, the panel is located between a pair of vertically spaced freezer doors and is independent of them, the panel forming the front of a drawer-like reservoir which is pulled out to get at the ice much as in those arrangements where a crisper drawer itself forms part of the front of the cabinet between a pair of main doors.

When a bin or drawer is used which opens through the door itself, as in U.S. Pat. No. 3,602,007 or 3,643,464, obviously a separate entrance must be formed in the door and closed by a separate hinged panel. This tends to be expensive, as compared with the cost of a plain door, and in the case of the drawer some means, as shown in U.S. Pat. No. 3,643,464, must be included in order to disconnect the panel from the drawer when the door is closed so that the latter can be opened without disturbing the drawer. If a drawer between two doors is employed, as in U.S. Pat. No. 3,744,270, a rather elaborate suspension for the drawer is required as indicated in that patent. The present invention, on the other hand, combines the advantages of the prior art constructions while reducing cost and complexity by providing direct access to ice from the front of the cabinet without need to open a main door.

SUMMARY OF THE INVENTION

Essentially, the present invention utilizes the panel-intermediate-a-pair-of-main-doors approach and so avoids the expense and complexity of going through one of the doors itself. The side edges of the panel seal against the vertical cabinet edges while its horizontal edges, as well as the adjacent edges of the doors above and below the panel, seal against a pair of horizontal mullions across the freezer opening, the panel being hinged to the lower mullion so that it can swing outwards. The panel opens to disclose a tray sitting freely on an interior shelf. The tray, which is filled from an automatic ice maker, can then be grasped and slid forward for access to the ice. The invention incorporates a mechanism which shuts off the ice maker when the panel is open or when the tray is not in place. Other and further features and advantages of the present invention will become apparent from the more detailed description which follows and the accompanying drawings.

DESCRIPTION OF THE PREFERRED EMBODIMENTS

Figure 1:
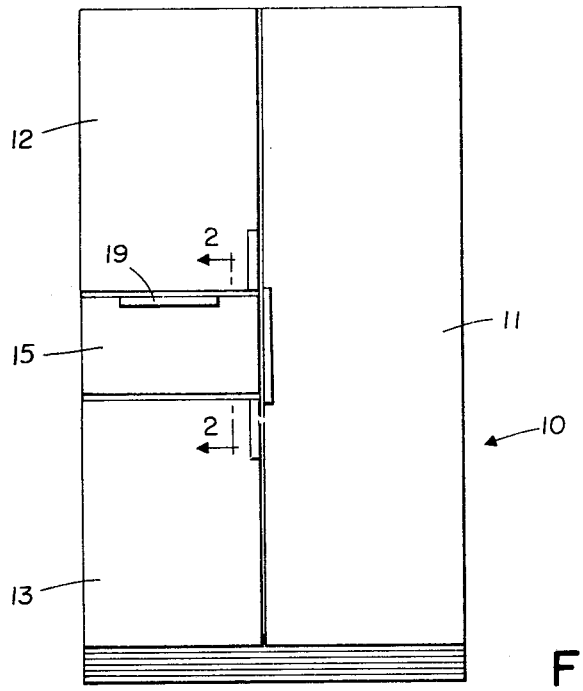
FIG. 1 is a front elevation of a typical side-by-side freezer-refrigerator incorporating the invention.
Figure 2:
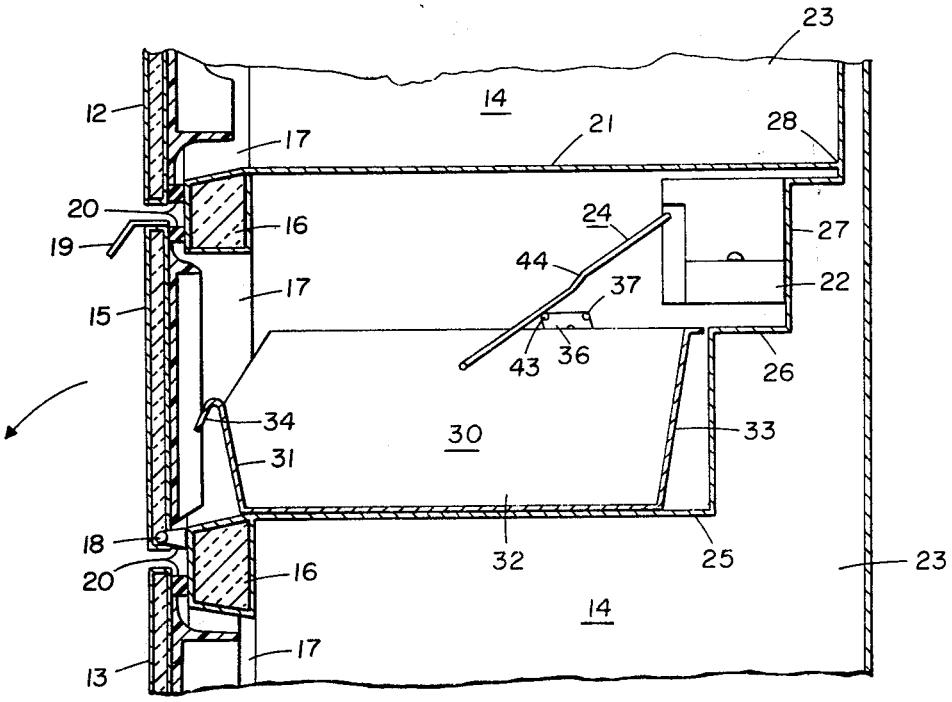
FIG. 2 is a vertical sectional view approximately along the line 2—2 of FIG. 1 illustrating the invention which utilizes a simple ice tray.

A typical freezer-refrigerator cabinet is shown at 10 having a door 11 closing the food compartment and a pair of vertically spaced doors 12 and 13 partially closing the freezing compartment 14, the remainder of which is closed by a panel 15 between the doors 12 and 13. The top and bottom edges of the panel 15 and the adjacent edges of the doors 12 and 13 overlap a pair of spaced horizontal mullions 16 spanning the width of the freezer compartment 14, the front faces of the mullions 16 being flush with those of the side edges 17 of the cabinet 10. The panel 15 is hinged at 18 along its lower edge to the lower mullion 16, and includes a pull 19 by which the panel 15 may be opened against the force of magnetic gaskets 20 by which the doors 12 and 13 and the panel 15 are sealed against the mullions 16, like gaskets also sealing the same against the faces of the cabinet edges 17. A shelf 21 extends rearwardly through the freezer compartment 14 from the top edge of the upper mullion 16, and below the rear portion of the shelf 21 a typical automatic ice maker 22 is positioned transversely of the freezer compartment 14 between its side walls 23. The ice maker 22 is equipped with a typical ice level sensing arm 24, extending forwardly from the ice maker 22, which swings up and down to turn the ice maker off and on depending upon the height of the arm 24.

Figure 3:
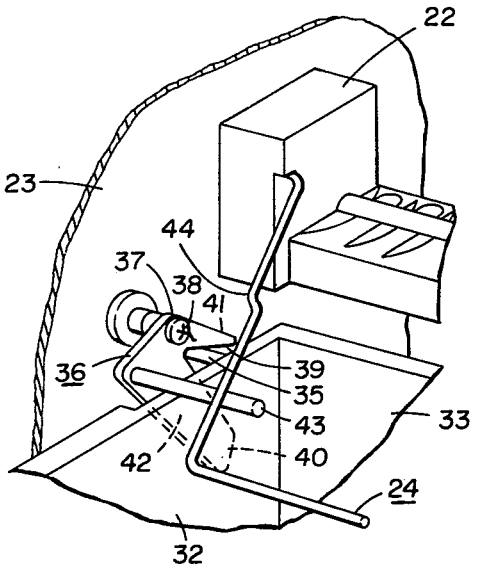
FIGS. 3 and 4 are detail views illustrating the mechanism utilized for shutting off the ice maker when the tray is either absent or the panel is open and the tray is in its forward position.
Figure 4:
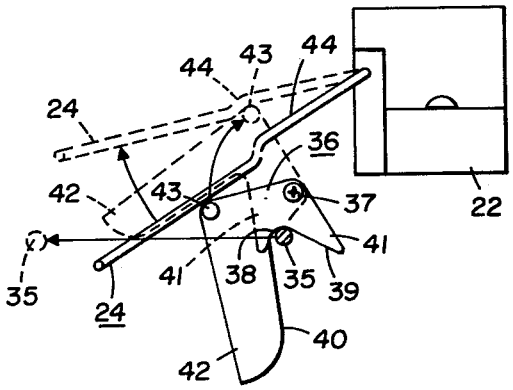

A second shelf 25 extends rearwardly from the top of the lower mullion 16 and at its back end is bent upwardly and then reversely to provide a ledge 26 under the ice maker 22 and a rear wall 27 to which it is attached, the rear ends of the shelves 21 and 25 being joined at 28. On the shelf 25 is disposed a rectangular ice tray 30 having a dropped front 31, side walls 32, and a rear wall 33. The tray 30 has a pull in the form of a lip 34 along the top of its front wall 31 thus providing for the tray 30 to be manually slidable on the shelf 25 at least part way out the exterior of the cabinet 10 when the panel 15 is swung open. The rear wall 33 of the tray 30 is located below the ice maker 22 so that the latter empties into it upon each harvest of ice cubes. In order to shut off the ice maker 22 when the tray 30 is pulled forwardly on the shelf 25, or is entirely removed from the cabinet 10, a mechanism is provided which automatically raises the sensing arm 24 to its shutoff position in those instances, the arm 24 normally extending down into the tray 30 to sense the level of the ice in it and to shut off the ice maker 22 when the tray 30 is full. That mechanism comprises a pin 35 extending from adjacent the top of the tray side wall 32 near the tray rear wall 33 laterally towards the adjacent cabinet side wall 23 to which in turn a shaped lever 36 of plate material is pivoted at 37. When the tray 30 is in location beneath the ice maker 22, the pin 35 resides in an inverted U-shaped seat 38 formed in the lever 36 below the level of the pivot 37. The sides of the seat 38 diverge to form a pair of opposing cam faces 39 and 40 along a pair of divergent arms 41 and 42, constituting the remainder of the lever 36. The upper end of the arm 42 is provided with an ear forward of the pin 35 and pivot 37 which is fitted with a second pin 43 extending over the top of the tray side wall 32 and laterally inwardly of the tray 30 to support the sensing arm 24 at its lowermost position (see FIGS. 3 and 4). When the tray 30 is pulled forward, its pin 35 acts against the cam face 40 of the arm 42 to swing the lever 36 about the pivot 37, causing the pin 43 in turn to raise the sensing arm 24 to its uppermost position where it and the lever 36 are retained by a seat 44 formed by an offset bend in the arm 24. The tray 30 can thus be removed, the pin 35 passing forwardly beneath the arm 42. When the tray is replaced, the pin 35 engages the cam face 39 on the other arm 41 and rotates the lever 36 about its pivot 37 in the opposite direction, forcing the pin 43 from the seat 44 and allowing it to lower the sensing arm 24.

Though the invention has been shown and described in terms of a particular embodiment, being the best mode known of carrying out the invention, it is not limited to that embodiment alone. Instead, the following claims are to be read as encompassing all adaptations and modifications of the invention falling within its spirit and scope.

We claim:

1. In a refrigeration unit having a food storage cabinet including freezing portions normally maintained at below freezing temperatures with vertically disposed front access openings, and ice apparatus disposed in one of the freezing portions, the ice apparatus including an automatic ice maker and an ice storage receptacle receiving ice manufactured by the ice maker, the combination therewith of a pair of vertically spaced, horizontally extending mullions forming a fixed part of the cabinet and defining one of said access openings, the storage receptacle being accessible through said one access opening; a panel having a lower edge portion hingedly secured along the lower mullion for swingable movement between a normally closed position in which the panel cooperates with the cabinet including the mullions to close said one access opening and an open position outwardly of the cabinet for access to the ice storage receptacle; the ice storage receptacle comprising a tray manually slidably movable on a shelf in said one freezing portion from a normal position therewithin out through said one access opening to a position at least partially outside of the cabinet after the panel is swung to its open position; and hinged door means having a normally closed position in which the door means cooperate with the cabinet including the mullions to close the remainder of the freezer access opening and movable to an open position for access to the remainder of the freezing portions; said ice maker including an ice level sensing arm movable from a lower position in the tray when in its normal position to an upper position above the tray, and including means to deactivate the ice maker when the tray is moved to said outside position, the deactivating means comprising: a first pin carried by the exterior of a tray side wall and extending laterally toward an adjacent portion of the cabinet, a plate-like lever disposed between said tray side wall and said portion of the cabinet and pivoted to the latter about a horizontal axis normal to the plane of the lever, the lever including a seat in an edge thereof below the level of the pivot and receiving the first pin when the tray is in its normal position, the seat opening generally downwards through said edge to provide, a pair of opposed, diverging cam faces straddling the first pin, the first pin and one of the cam surfaces being effective to rotate the lever about its pivot in a second direction when the tray is returned to is normal position, and a second pin extending from the lever laterally across the top of said tray side wall and beneath the sensing arm when in its lower position, the second pin being disposed to engage and lift the sensing arm to its upper position when the lever is rotated in its first direction and to allow return of the sensing arm to its lower position when the lever is rotated in its second direction.

* * * * *